US008969729B2

(12) United States Patent
Jahnel et al.

(10) Patent No.: US 8,969,729 B2
(45) Date of Patent: Mar. 3, 2015

(54) HIGH-VOLTAGE BUSHING WITH CONDUCTIVE INSERTS FOR DC VOLTAGE AND METHOD FOR PRODUCING THE BUSHING

(71) Applicant: Siemens Aktiengesellschaft, Munich (DE)

(72) Inventors: Dietmar Jahnel, Troisdorf (DE); Achim Langens, Lohmar (DE); Tim Schnitzler, Kreuzau (DE)

(73) Assignee: Siemens Aktiengesellschaft, Munich (DE)

( * ) Notice: Subject to any disclaimer, the term of this patent is extended or adjusted under 35 U.S.C. 154(b) by 29 days.

(21) Appl. No.: 13/833,633

(22) Filed: Mar. 15, 2013

(65) Prior Publication Data

US 2013/0240249 A1 Sep. 19, 2013

(30) Foreign Application Priority Data

Mar. 15, 2012 (DE) ..... 10 2012 204 052

(51) Int. Cl.

| | |
|---|---|
| ***H01B 17/26*** | (2006.01) |
| ***H01B 17/42*** | (2006.01) |
| ***H01B 19/04*** | (2006.01) |
| ***H01B 3/52*** | (2006.01) |
| *H01B 17/28* | (2006.01) |

(52) U.S. Cl.

CPC ..... *H01B 17/26* (2013.01); *H01B 17/42* (2013.01); *H01B 19/04* (2013.01); *H01B 3/52* (2013.01); *H01B 17/28* (2013.01)

USPC ..... 174/142; 174/650

(58) Field of Classification Search

CPC ..... H01B 17/28; H01B 17/26; H01B 17/42; H01B 19/04; H01B 3/52; H01B 13/0358; H02G 3/22

USPC ..... 174/142, 143, 152 R, 652, 650; 439/181

See application file for complete search history.

(56) References Cited

U.S. PATENT DOCUMENTS

| | | | | |
|---|---|---|---|---|
| 4,500,745 | A * | 2/1985 | Miggins | 174/31 R |
| 4,584,429 | A | 4/1986 | Raketti et al. | |
| 5,198,622 | A * | 3/1993 | Hammarsten et al. | 174/143 |
| 6,678,139 | B1 * | 1/2004 | Greuter et al. | 361/117 |
| 2008/0179077 | A1 * | 7/2008 | Krivda et al. | 174/152 R |
| 2012/0071014 | A1 * | 3/2012 | Dais et al. | 439/181 |

FOREIGN PATENT DOCUMENTS

| | | |
|---|---|---|
| DE | 1490056 A1 | 7/1969 |
| GB | 246799 A | 2/1927 |

OTHER PUBLICATIONS

Andreas Küchler, "Hochspannungstechnik" (High-Voltage Engineering) 2nd Edition, 2005, pp. 100 and 101, Figs. 2.4-28; ISBN 3-540-21411-9 Springer Verlag; DE—described on p. 1 of the specification.

* cited by examiner

*Primary Examiner* — Yuriy Semenenko

(74) *Attorney, Agent, or Firm* — Laurence A. Greenberg; Werner H. Stemer; Ralph E. Locher

(57) ABSTRACT

A high-voltage bushing with conductive inserts for a DC voltage has a bushing body surrounding a high-voltage conductor and containing a paper insulation. The bushing body tapers conically, at least at one end region thereof, from a ground-potential-side location to a high-voltage-side end and is surrounded by an insulating barrier. In order to provide a high-voltage bushing of this type with a particularly good potential distribution, the outside of the bushing body is coated at least in the region of the at least one end region with a coating to form a coating layer, which has a greater electrical conductivity than the bushing body.

6 Claims, 3 Drawing Sheets

HIGH-VOLTAGE BUSHING WITH CONDUCTIVE INSERTS FOR DC VOLTAGE AND METHOD FOR PRODUCING THE BUSHING

CROSS-REFERENCE TO RELATED APPLICATION

This application claims the priority, under 35 U.S.C. §119, of German application DE 10 2012 204 052.8, filed Mar. 15, 2012; the prior application is herewith incorporated by reference in its entirety.

BACKGROUND OF THE INVENTION

Field of the Invention

The invention relates to a high-voltage bushing with conductive inserts for a DC voltage with a bushing body surrounding a high-voltage conductor and containing paper insulation. The bushing body tapers conically, at least at one end region thereof, from a ground-potential-side location to a high-voltage-side end and is surrounded by an insulation barrier.

A high-voltage bushing of this type is known from the book entitled "Hochspannungstechnik" (High-Voltage Engineering) by A. Küchler, $2^{nd}$ edition, 2005, pages 100 and 101. In particular, the lower illustration from FIG. 2.4-28 shows a high-voltage bushing of this type, in which the insulation barrier consists of individual pressboard barriers. In conjunction with oil which is conductive compared to the conductivity of the bushing body and the pressboard barriers, a high-voltage bushing which has a relatively good potential distribution is obtained.

SUMMARY OF THE INVENTION

It is accordingly an object of the invention to provide a high-voltage bushing with conductive inserts for a DC voltage and a method for producing the bushing which overcome the above-mentioned disadvantages of the prior art methods and devices of this general type, which is distinguished by an even better potential distribution.

With the foregoing and other objects in view there is provided, in accordance with the invention a high-voltage bushing for a DC voltage. The bushing contains conductive inserts, a high-voltage conductor, an insulation barrier, and a bushing body surrounding the high-voltage conductor and contains a paper insulation. The bushing body tapers conically, at least at one end region thereof, from a ground-potential-side location to a high-voltage-side end and is surrounded by the insulation barrier. The bushing body has an outer side coated at least in a region of the at least one end region with a coating forming a coating layer. The coating layer has a greater electrical conductivity than the bushing body.

In order to solve this problem in the case of a high-voltage bushing of the type mentioned at the outset, according to the invention the outside of the bushing body is coated at least in the region of the at least one end region with a coating to form a coating layer, which has a greater electrical conductivity than the bushing body.

A significant advantage of the high-voltage bushing of the invention consists in that, even at exposed locations in the interior of the bushing, the applied coating layer has the effect that peak loads caused by concentrations of the electrical field do not occur. Furthermore, a material saving is made because the high-voltage bushing of the invention can have smaller dimensions for a certain voltage loading than the known high-voltage bushing can at the same voltage loading. In this case, these advantages are achievable in an inexpensive way by the coating layer simply being applied to the outside of the bushing body.

In the case of the high-voltage bushing of the invention, the coating layer may have no connection to high and ground potential. However, it is considered to be particularly advantageous for the coating layer to be connected to the high voltage at the high-voltage-side end of the at least one end region of the bushing body and to be connected to ground potential at the ground-potential-side location. In this case, a particularly good and regular potential distribution over the entire high-voltage bushing results.

Furthermore, with regard to a regular potential distribution, it has proven to be particularly advantageous for the electrical conductivity of the coating layer to be approximately two orders of magnitude greater than that of the bushing body.

As is known per se, for the high-voltage bushing of the invention, the paper insulation of the bushing body is likewise a paper insulation impregnated with epoxy resin, which is advantageously distinguished by a high insulation resistance.

The invention also relates to a method for producing a high-voltage bushing with conductive inserts for DC voltage with a bushing body surrounding a high-voltage conductor and containing paper insulation, which bushing body tapers conically, at least at one end region thereof, from a ground-potential-side location to a high-voltage-side end and is surrounded by an insulation barrier; a method of this type can be taken from the aforesaid book.

It is an object of the invention to specify a method for producing a high-voltage bushing, with which a high-voltage bushing having a particularly good potential distribution can be produced in a simple manner.

In order to achieve this object in the case of a method of the type mentioned above, according to the invention the outside of the bushing body is coated at least in the region of the at least one end region with a coating to form a coating layer, which has a greater electrical conductivity than the bushing body.

A particular advantage of the method of the invention consists in that, simply by applying a coating layer to the outside of the bushing body, it is possible to produce a high-voltage bushing which has the advantages specified above for high-voltage bushings.

For the reasons already mentioned above, it is advantageous in the case of the method of the invention for the coating layer to be connected to high voltage at the high-voltage-side end of the at least one end region of the bushing body and to be connected to ground potential at the ground-potential-side location.

It is also advantageous for a coating having a conductivity which is approximately two orders of magnitude greater than that of the bushing body to be used as the coating layer.

It is likewise advantageous for a paper insulation impregnated with epoxy resin to be used as the paper insulation of the bushing body.

Other features which are considered as characteristic for the invention are set forth in the appended claims.

Although the invention is illustrated and described herein as embodied in a high-voltage bushing with conductive inserts for a DC voltage and a method for producing the bushing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
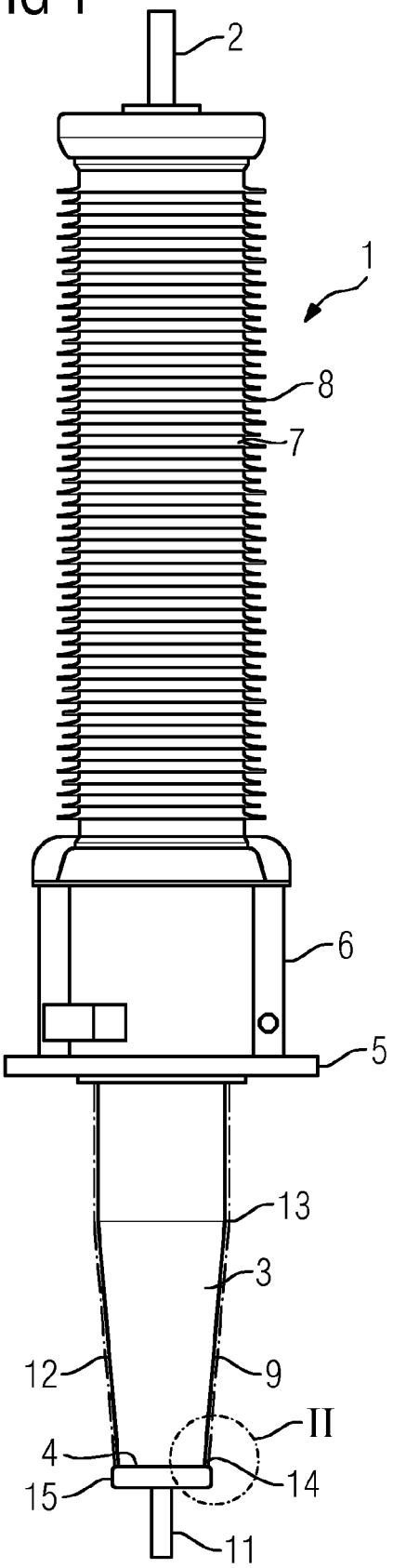
FIG. 1 is a diagrammatic, side view of an exemplary embodiment of a high-voltage bushing for a transformer according to the invention.

Referring now to the figures of the drawing in detail and first, particularly, to FIG. 1 thereof, there is shown a high-voltage bushing 1 which provides an electrical transition from a non-illustrated transformer to an outdoor high-voltage connection 2. As can also be seen in FIGS. 1 and 2, the high-voltage bushing 1 has a bushing body 3, which extends from the high-voltage or transformer-side end 4 thereof (the lower end in FIG. 1) through a support flange 5 to the outdoor high-voltage connection 2. On the support flange 5 is an annular housing part 6 and on the housing part 6 is an outdoor-side part 7 of the high-voltage bushing 1 with screens 8.

Figure 2:
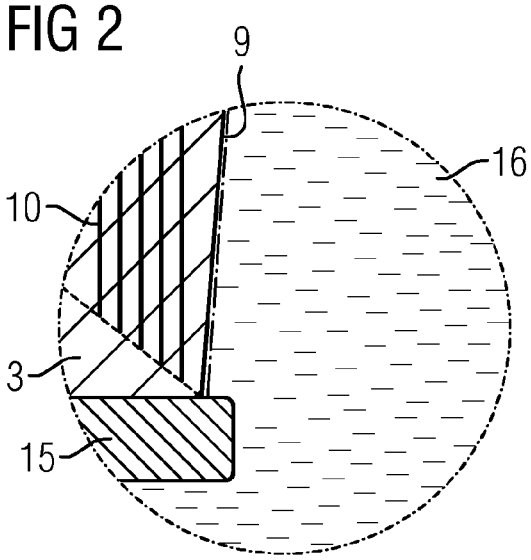
FIG. 2 is a diagrammatic, side view of a detail of the exemplary embodiment of FIG. 1.

As is also shown in FIGS. 1 and 2, the outside of the bushing body 3 is provided with a coating layer 9, which has a greater electrical conductivity than the bushing body 3, for example a conductivity which is two orders of magnitude greater. The bushing body 3 is wound from paper, conductive inserts 10 being wound in during the winding in a known manner to form a capacitor-controlled high-voltage bushing 1. The bushing body 3 formed in this manner is impregnated with casting resin. A high-voltage conductor 11 runs inside the bushing body 3.

As is evident from FIG. 1 in particular, the bushing body 3 has an end region 12, which tapers conically from a location 13 on the ground-potential side to the high-voltage-side end 4 with an electrode 15. The coating layer 9 is galvanically connected to the electrode 15; on the other side, there is also a connection between the coating layer 9 and the support flange 5 or the annular housing part 6, which are at ground potential.

FIG. 2 indicates that both the electrode 15 and the bushing body 3 are surrounded on the outside by an insulating oil 16 of the transformer. In this case there is also an insulation barrier (not shown in FIGS. 1 and 2) in the insulating oil.

Figure 3:
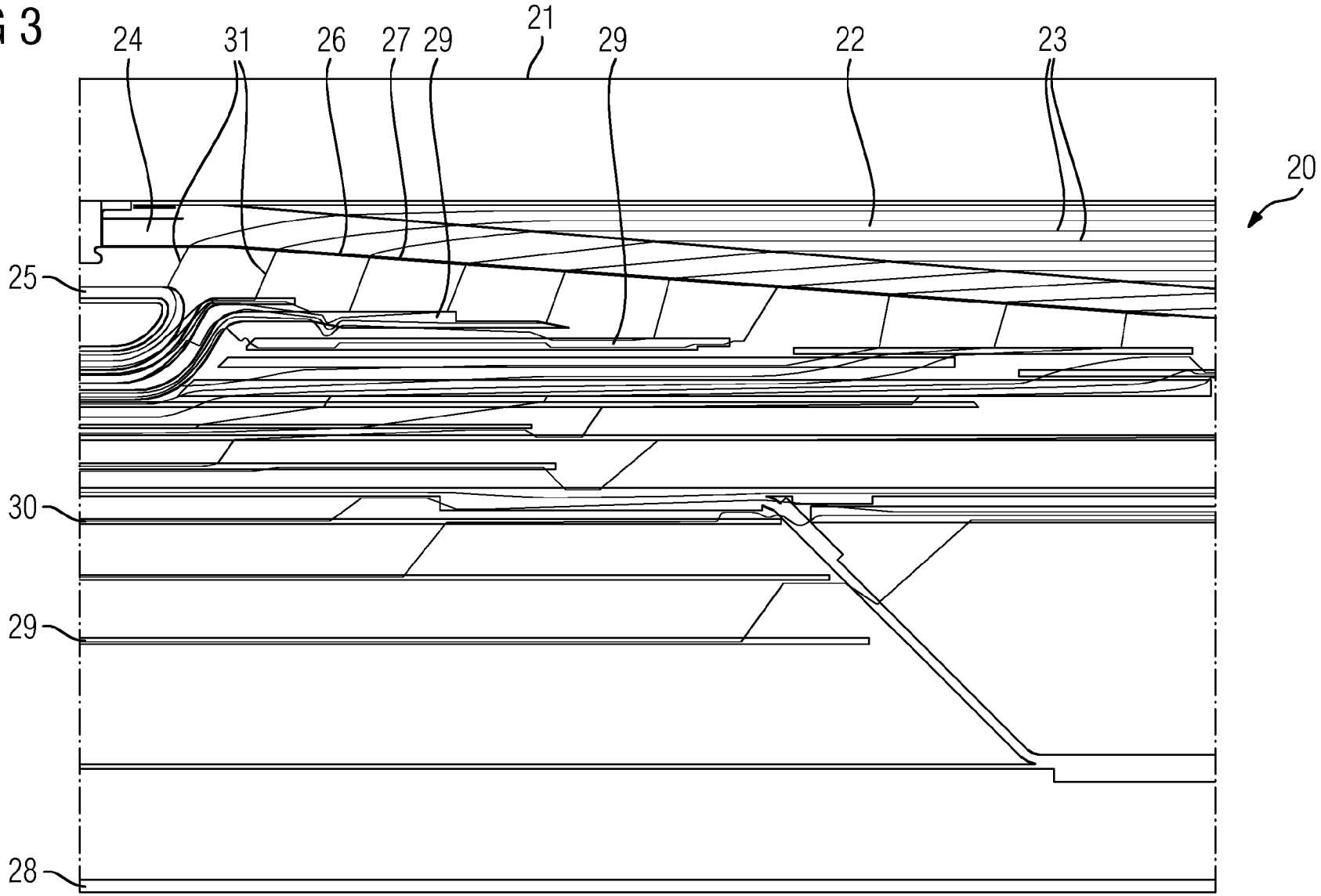
FIG. 3 is a diagrammatic, sectional view of an excerpt of a section through a further exemplary embodiment of the high-voltage bushing of the invention to illustrate the basic mode of operation of the coating layer on the bushing body.

FIG. 3 shows a high-voltage bushing 20 with a high-voltage conductor 21, which carries a bushing body 22 of wound paper with conductive inserts 23. A high-voltage-side end 24 of the bushing body 22 is opposite an electrode 25, which is connected to the high-voltage conductor 21 in a manner which is not shown and is provided with a coating layer 27 on an outer surface 26 thereof. The coating layer 27 has a conductivity which is approximately two orders of magnitude greater than that of the bushing body 22. The high-voltage bushing 20 is closed to the outside by a housing 28.

Individual barrier elements 29 of an insulation barrier 30 are partially applied in close contact and partially arranged cylindrically around the high-voltage conductor 21. As a result of this, together with the coating layer 27, a very regular potential distribution is created, as indicated by the marked field lines 31.

Figure 4:
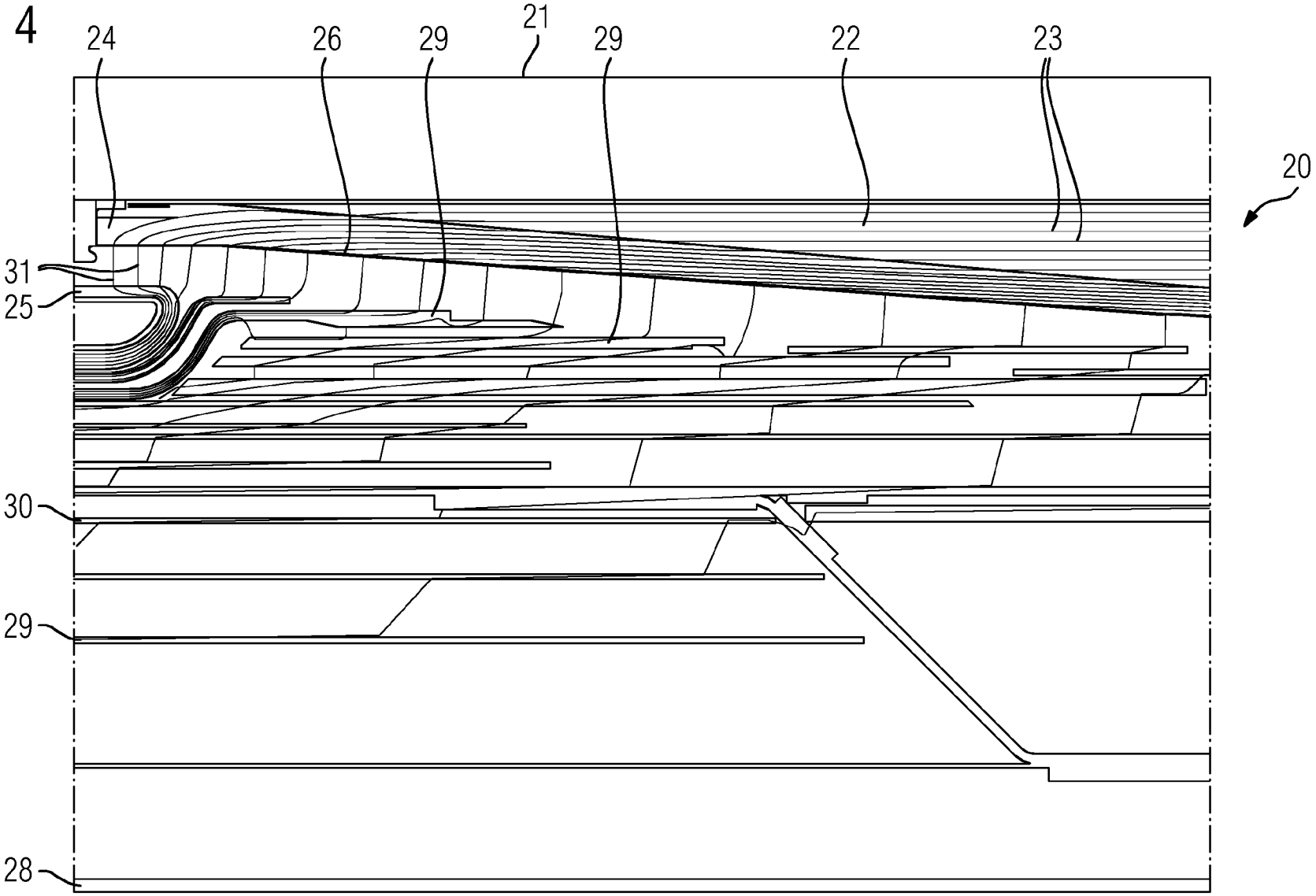
FIG. 4 is a diagrammatic, sectional view of an identical configuration to that shown in FIG. 3, only without a coating layer.

In comparison with this, FIG. 4 shows how the potential distribution appears when the coating layer 27 is not present on the same arrangement as in FIG. 3.

The invention claimed is:

1. A high-voltage bushing for a DC voltage, comprising:
conductive inserts;
a high-voltage conductor;
an insulation barrier; and
a bushing body surrounding said high-voltage conductor, said bushing body formed of a wound paper insulation and said conductive inserts for a DC voltage, said bushing body tapering conically, at least at one end region thereof, from a ground-potential-side location to a high-voltage-side end and surrounded by said insulation barrier, said bushing body having an outer side coated at least in a region of said at least one end region with a coating forming a coating layer, said coating layer having a greater electrical conductivity than said bushing body.

2. The high-voltage bushing according to claim 1, wherein the electrical conductivity of said coating layer is approximately two orders of magnitude greater than that of said bushing body.

3. The high-voltage bushing according to claim 1, wherein said paper insulation of said bushing body is impregnated with an epoxy resin.

4. A method for producing a high-voltage bushing, which comprises the steps of:
providing a bushing body surrounding a high-voltage conductor, the bushing body formed from a paper insulation and conductive inserts for a DC voltage, the bushing body formed tapering conically, at least at one end region thereof, from a ground-potential-side location to a high-voltage-side end and surrounded by an insulation barrier; and
coating an outer side of the bushing body at least in the region of the at least one end region with a coating for forming a coating layer, the coating layer having a greater electrical conductivity than the bushing body.

5. The method according to claim 4, which further comprises providing the coating layer with an electrical conductivity which is approximately two orders of magnitude greater than that of the bushing body.

6. The method according to claim 4, which further comprises impregnating the paper insulation with an epoxy resin.

* * * * *